US007835229B2

(12) United States Patent
Chaignat

(10) Patent No.: US 7,835,229 B2
(45) Date of Patent: Nov. 16, 2010

(54) DATE MECHANISM FOR A TIMEPIECE

(75) Inventor: Julien Chaignat, Le Landeron (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 12/492,208

(22) Filed: Jun. 26, 2009

(65) Prior Publication Data

US 2010/0002544 A1 Jan. 7, 2010

(30) Foreign Application Priority Data

Jul. 3, 2008 (EP) ..... 08159637

(51) Int. Cl.
*G04B 19/24* (2006.01)

(52) U.S. Cl. ..... 368/37; 368/35; 368/28

(58) Field of Classification Search ..... 368/28, 368/35, 37

See application file for complete search history.

(56) References Cited

U.S. PATENT DOCUMENTS

| | | | | |
|---|---|---|---|---|
| 6,097,672 | A * | 8/2000 | Kitahara et al. | 368/35 |
| 6,711,100 | B2 * | 3/2004 | Rochat et al. | 368/35 |
| 6,925,032 | B2 | 8/2005 | Willemin et al. | |
| 6,934,221 | B2 * | 8/2005 | Willemin et al. | 368/28 |
| 7,403,449 | B2 * | 7/2008 | Racine et al. | 368/37 |
| 2005/0056691 | A1 | 3/2005 | Eisenegger et al. | |
| 2005/0111302 | A1 * | 5/2005 | Willemin et al. | 368/28 |
| 2005/0111303 | A1 | 5/2005 | Willemin et al. | |
| 2005/0128876 | A1 * | 6/2005 | Lizzi et al. | 368/37 |

FOREIGN PATENT DOCUMENTS

EP 1 536 299 A1 6/2005

* cited by examiner

*Primary Examiner*—Vit W Miska
*Assistant Examiner*—Jason Collins
(74) *Attorney, Agent, or Firm*—Sughrue Mion, PLLC

(57) ABSTRACT

Date mechanism (1) for a timepiece, including:

at least first (2) and second (3) date rings, rotatably mounted relative to each other, said rings having one surface provided with successive date markings (24, 34), the first date ring (2) having a display window (21), arranged between two successive markings, the first date ring (2) being superposed on the second date ring (3), each of said two date rings (2, 3) having teeth (22, 32) distributed on the periphery thereof, each tooth being associated with a respective marking (24, 34) or with the display window (21);

a control wheel (4) for the first and second date rings (2, 3);

characterized in that the control wheel (4) is provided with first (41) and second (42) superposed tiers of toothings, each toothing tier including one portion provided with adjacent teeth and one tooth-free portion, the tooth-free portion of one tier being arranged vertical to the toothed portion of the other tier, one tooth of the first tier (41) being superposed on one tooth of the second tier (42), the teeth of the first and second tiers (41, 42) of the control wheel (4) respectively driving the first (2) and second (3) date rings via the teeth (22, 32) thereof.

14 Claims, 3 Drawing Sheets

DATE MECHANISM FOR A TIMEPIECE

This application claims priority from European Patent Application No. 08159637.1 filed Jul. 3, 2008, the entire disclosure of which is incorporated herein by reference.

The invention concerns timepieces fitted with a date mechanism. The invention concerns, in particular, timepieces with a large aperture provided with two superposed date rings.

The analogue display of dates in wristwatches generally relies upon a date ring provided with 31 sectors bearing the markings 1 to 31 for the different days of the month. The drawback of this type of watch, however, is that the dimension of the field for each sector is reduced to a $31^{st}$ of the circumference of the ring. In a small format wristwatch, the dimension of this field is insufficient to have a sufficiently legible date display.

EP Patent Application No 1 536 299 discloses a movement fitted with a counting and cyclical aperture display mechanism for a watch date device, which provides date information in a large format, approximately twice that of a 31 sector date device. This mechanism includes a top ring fitted with 16 sectors, with 15 successive markings of a cycle of 31 positions, the $16^{th}$ sector being a surplus sector with an open or transparent window. The movement also includes a bottom ring fitted with 17 sectors, with the other 16 successive markings of the cycle, the $17^{th}$ sector being a surplus sector. The top ring is kept immobile, whereas a command causes the successive markings of the bottom ring to pass in rotation in the window arranged in the top ring. The window is arranged underneath the aperture in a covering plate of the watch. The markings on the bottom ring thus appear in succession in the aperture. Then the bottom ring is kept immobile while a command causes the successive markings on the top ring to pass in rotation such that they appear in succession in the aperture, with the top ring covering the markings on the bottom ring. Each ring has peripheral toothings formed of a succession of regularly spaced teeth, the peripheral teeth extending in two tiered rows. The teeth of the top and bottom rows of the top ring are superposed. The teeth of the top and bottom rows of the bottom ring are staggered. One place on each of the toothings of the top and bottom rings has no teeth so that the top ring can thus be held in the display position without being driven for dates 1 to 16, the bottom ring being held in a waiting position without being driven for positions 17 to 31. In order to restart rotating at the change from 31 to 1 and from 16 to 17, the rings have vertical projecting portions, which mesh in these positions. These projecting portions are made in the outer periphery of the rings. Two superposed control wheels respectively drive the top and bottom rings. These wheels complete one revolution per day and are fitted with an activating finger that drives one tooth of a bottom or top ring once per day. A correction mechanism can alter the indication provided by the date mechanism.

However, this mechanism has some drawbacks. Each ring has a complex, three-dimensional structure, with toothings on several levels and stop members that project relative to the flat display surface of the ring. This structure involves a plastic moulding manufacturing method, which leads to a relatively thick ring, which affects the overall space requirement of the movement. This also leads to a relatively expensive ring, which increases the cost price of the movement. Moreover, the date display could do with being enlarged.

It is an object of the invention to overcome one or more of these drawbacks. The invention thus concerns a date mechanism for a timepiece, including:

at least first and second date rings mounted so as to rotate relative to each other, said rings having one surface bearing successive date markings, the first date ring having a display window arranged between two successive markings, the first ring being superposed on the second date ring, each of said date rings having teeth distributed over the periphery thereof, each tooth being associated with a respective marking or with the display window;

a control wheel for the first and second date rings, characterized in that the control wheel is fitted with first and second superposed tiers of toothings, each toothing tier including one portion fitted with adjacent teeth and one portion without teeth, the tooth-free portion of one tier being arranged vertical to the toothed portion of the other tier, the teeth of the first and second tiers of the control wheel respectively driving the first and second date rings via their teeth.

Other features and advantages of the invention will appear clearly from the following description, made by way of non-limiting illustration, with reference to the annexed drawings, in which.

The invention proposes a date mechanism for a timepiece. The mechanism includes two superposed date rings, bearing successive date markings. These date rings are rotatably mounted relative to each other. The top ring has a window arranged between two markings. The rings have drive teeth, each tooth being associated with a marking or a window. A control wheel has two superposed tiers of toothings. These tiers are coupled to each other in rotation. Each tier includes one portion fitted with adjacent teeth and one portion without any teeth. Each tier drives a respective date ring. The portions provided with teeth and the tooth-free portions of the control wheel are configured such that, during rotation of the control wheel, at least one tooth of the top tier and one tooth of the bottom tier simultaneously drive the two rings, and such that only one date ring is driven in rotation simultaneously by the other teeth.

Figure 1:
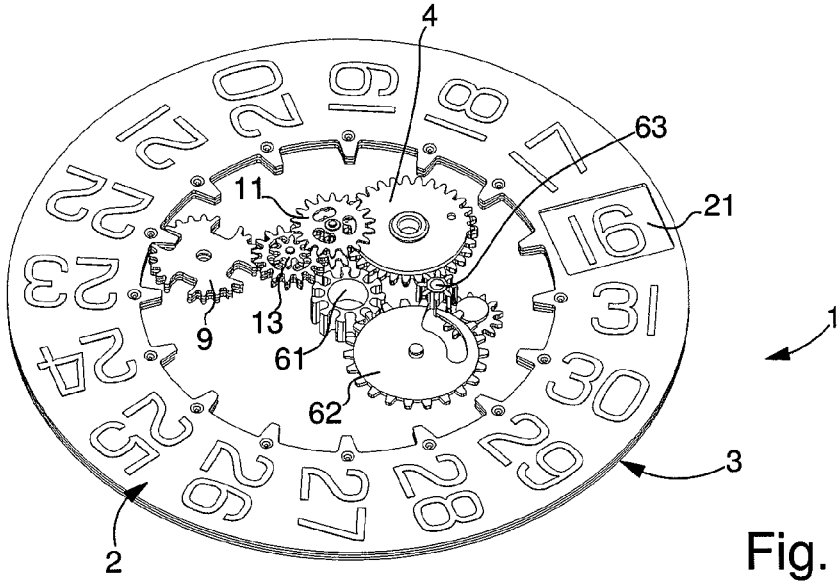
FIG. 1 is a perspective view of the main components of a date mechanism according to one embodiment of the invention.

FIG. 1 shows more precisely one embodiment of a date mechanism 1 according to the invention. This mechanism is for mounting in the bottom plate of a watch, which is not illustrated, typically a wristwatch for displaying the day of the month. Mechanism 1 includes a top date ring 2 and a bottom date ring 3. The top date ring 2 is superposed on the bottom date ring 3. Top date ring 2 has sixteen sectors regularly distributed over its circumference. The sixteen sectors include successive markings from "17" to "31", and a window 21, placed between markings "17" and "31", on the top surface 2. The dimension of window 21 is sufficient to display the markings present on bottom date ring 3. A "window" means both a component made of material that is transparent to light or a through aperture arranged in top ring 2. Date ring 3 has sixteen sectors regularly distributed over its circumference. The sixteen sectors include successive markings from "1" to "16" on the top surface of ring 3. The watch will typically have a plate covering mechanism 1, secured to the bottom plate of the watch movement. An aperture will be arranged in this covering plate, so as to display markings present on rings 2 and 3 in the aperture.

Figure 2:
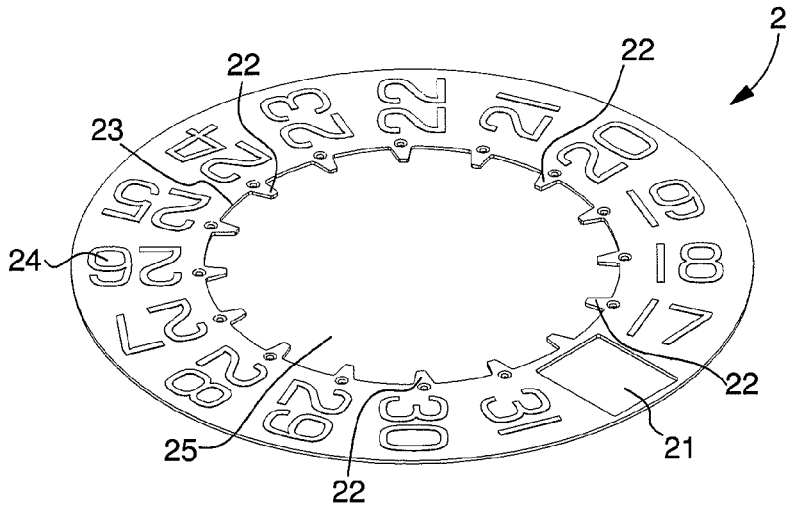
FIG. 2 is a perspective view of a top date ring.
Figure 3:
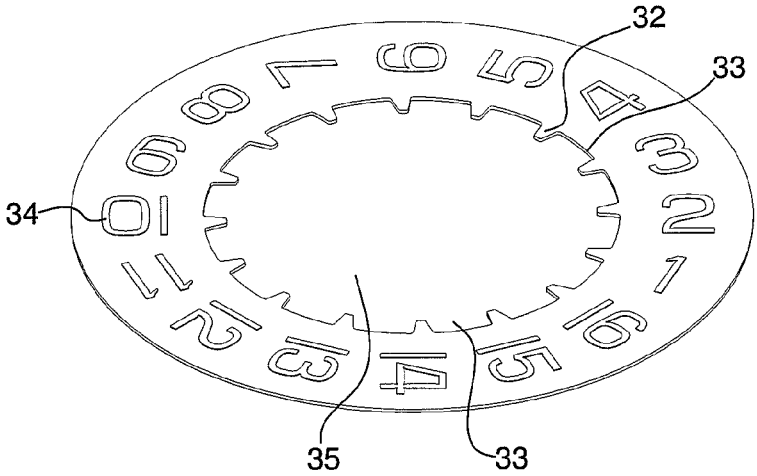
FIG. 3 is a perspective view of a bottom date ring.

FIGS. 2 and 3 show more precisely constituent details of rings 2 and 3. Date rings 2 and 3 respectively have bores 25 and 35 in the median part thereof. Teeth 22 project radially towards the inside of bore 25 from an inner periphery 23 of ring 2. Similarly, teeth 32 project radially towards the inside of bore 35 from an inner periphery 33 of ring 3. Teeth 22 and 32 are regularly spaced along inner peripheries 23 and 33 of the respective date rings 2 and 3. One tooth 22 is associated with each marking 24 or window 21 of top date ring 2. Similarly, one tooth 32 is associated with each marking 34 of bottom date ring 3.

Mechanism 1 further includes a control wheel 4 for driving the first and second rings 2 and 3. Control wheel 4 completes one revolution in 31 days. Control wheel 4 is driven in rotation via a pinion on hour wheel 61 and via gears 62 and 63, which will not be described further here.

Figure 4:
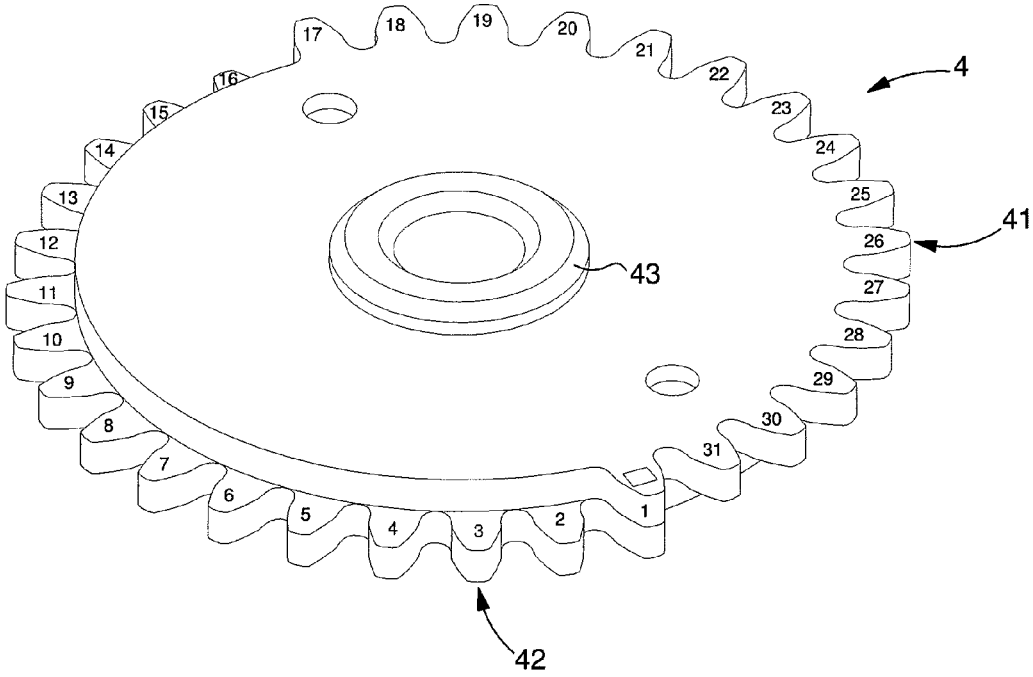
FIG. 4 is a perspective view of a control wheel.

As detailed more precisely in FIG. 4, control wheel 4 has first and second superposed tiers of toothings 41 and 42. Tiers 41 and 42 each have, on the external periphery thereof, one portion fitted with successive adjacent teeth and one portion without any teeth. The teeth are regularly distributed in the portion provided with teeth and spaced at an angle of $2\pi/31$.

A reference has been added to each of the teeth of tiers 41 and 42, indicating which sector or rings 2 and 3 is controlled by that tooth. Thus, tier 41 has control teeth for sectors "17" to "31" and window 21. The tooth-free portion thus extends between the "window" and "17" teeth. Tier 42 includes control teeth for sectors "1" to "16". The tooth-free portion extends thus between teeth "16" and "1". The toothed portion of one tier is placed vertical to the tooth-free portion of the other tier. Thus, the teeth of tier 41 controlling markings "17" to "31" of ring 2 are arranged vertical to the tooth-free portion of tier 42. The tooth-free portion of tier 41 is placed vertical to the teeth of tier 42 controlling markings "2" to "16" of ring 3. Exceptionally, the tooth of tier 41, which controls sector "1" of ring 3 is arranged vertical to the tooth of tier 42 that controls window 21 of ring 2.

The first and second tiers 41 and 42 are coupled in rotation, such that a simple rotation of wheel 4 through one revolution drives one or other of the two rings 2 and 3. Tiers 41 and 42 are configured to drive respectively rings 2 and 3 via their toothed portions. Multiplier wheel sets 11, 13 form a respective kinematic connection between tiers 41 and 42 and rings 2 and 3. The multiplier wheel sets guarantee that the daily rotation of wheel 4 involves rotation of one date ring from one date to the next date.

Figure 5:
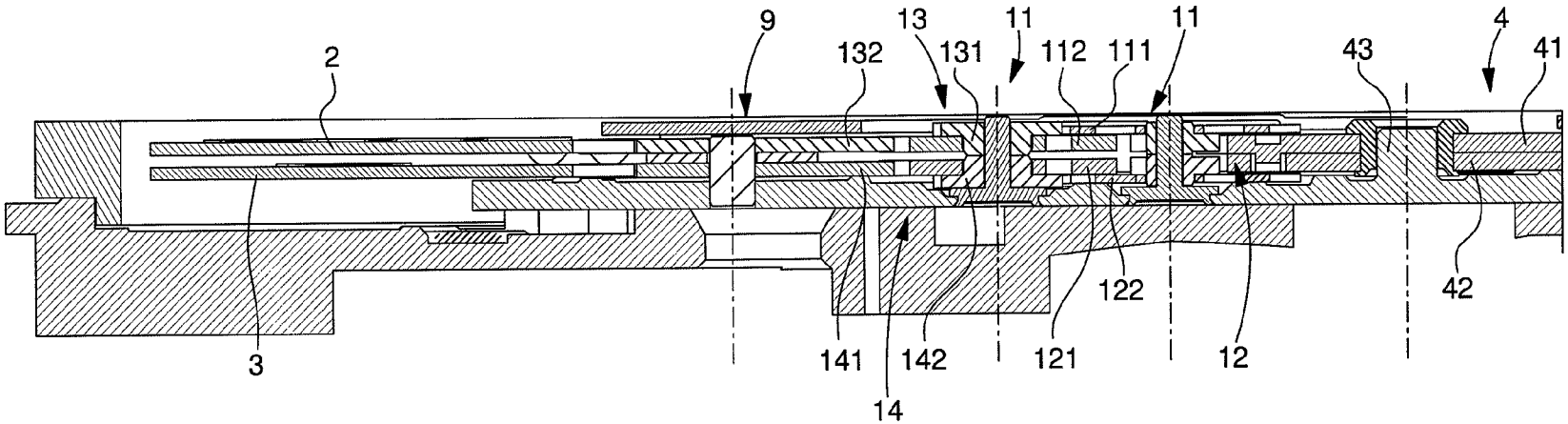
FIG. 5 is a side view of a reduction mechanism coupled to the control wheel.

As illustrated in FIG. 5, tier 41 is coupled to ring 2 via a first multiplier gear 11, a third multiplier gear 13 and a top gear of a corrector gear train 9. Multiplier gear 11 includes a pinion 112 that is driven by the toothed part of tier 41. Multiplier gear 11 further includes a wheel 111 secured to pinion 112. Multiplier gear 13 includes a pinion 131 driven by wheel 111. Multiplier gear 13 further includes a wheel 132 secured to pinion 131 and driving the top gear of corrector gear train 9.

Tier 42 is coupled to ring 3 via a second multiplier gear 12, a fourth multiplier gear 14 and the bottom gear of corrector gear train 9. Multiplier gear 12 includes a pinion 121 driven by the toothed part of tier 42. Multiplier gear 12 further includes a wheel 122 secured to pinion 121. Multiplier gear 14 includes a pinion 142 driven by wheel 122. Multiplier gear 14 further includes a wheel 141 secured to pinion 142 and driving the bottom gear of corrector gear train 9.

As can be seen upon examining FIG. 5, the first and second multiplier gears 11 and 12 are rotatably mounted about the same axis. The first and second multiplier gears are independent of each other. Similarly, the third and fourth multiplier gears 13 and 14 are rotatably mounted about the same axis. The third and fourth multiplier gears are independent of each other. Since these pairs of multiplier gears are mounted on the same axes, the mechanism 1 obtained is relatively compact.

During rotation of control wheel 4, mechanism 1 operates as follows. It is assumed that aperture 21 and marking "1" are initially placed underneath the aperture of the covering plate. The first date of the month is thus displayed to the user.

During date changes 2 to 16 controlled by wheel 4:

- the tooth-free part of tier 41 is opposite the first wheel set 11. Wheel 2 is thus not being driven and window 21 remains stationary, placed under the aperture;
- the teeth of tier 42, which control the movement of markings "2" to "16" will mesh in succession with wheel set 12, and thus drive ring 3 via its teeth 32. Thus, the dates "2" to "16" will be displayed in succession in the aperture through window 21.

When, controlled by wheel 4, the date changes from "16" marked on the bottom date ring 3, to "17" marked on top date ring 2, then subsequently from "17" to "31":

- the tooth-free part of tier 42 is opposite second wheel set 12. Ring 3 is thus not being driven and the marking "16" remains stationary under the aperture;
- the teeth of tier 41, which control the movement of markings "17" to "31" will mesh in succession with wheel set 11, and thus drive ring 2 via its teeth 22. Thus, the dates "17" to "31" will be displayed in succession in the aperture.

When the date "31", carried by top ring 2, changes to "1" carried by bottom ring 3, the tooth of tier 41, which controls the movement of the window and which is superposed on the tooth of tier 42 that controls the movement of marking "1", are simultaneously meshed with wheel sets 11 and 12 respectively. Ring 2 thus pivots to place window 21 underneath the aperture, whereas ring 3 pivots to place marking "1" underneath the aperture.

Thus, rings 2 and 3 are simply slaves of the teeth of tiers 41 and 42 respectively, which means that simple teeth can be used, arranged in the thickness of the ring and distributed regularly along the inner periphery thereof. It will be noted, in particular, that there is no interaction between these two rings. Moreover, a single tier of teeth on each ring is sufficient to ensure that it is driven. The simplicity of the driving and shapes of rings 2 and 3 also means that they can be made with fine sheet metal, which reduces their thickness and thus the thickness of the resulting mechanism for a given rigidity and resistance. Date rings 2 and 3 are advantageously flat, such that mechanism 1 is compact and simpler to make. Rings 2 and 3 could be made for example by cutting a sheet metal using any appropriate technique, such as stamping, laser cutting, water jet cutting or another technique. Teeth 22 and 32 will thus have the same thickness as the body of the ring bearing the markings. Rings 2 and 3 will have to be held slightly apart from each other, for example by stamping bumps in the bottom date ring 3.

It may be noted that, according to the invention, ring 3 does not require any additional sectors free of markings. Thus, the dimension of markings 34 on this ring 3 is increased. Moreover, it may be noted that for an odd number of dates (31 in this case), rings 2 and 3 may have the same number of teeth (16 in this case). The manufacturing processes for rings 2 and 3 may therefore be extremely close, which reduces their cost price.

Control wheel 4 includes, in this case, cut sheet metal forming the toothing tiers 41 and 42. A rivet 43 couples tiers 41 and 42 and also guides the control wheel in rotation via its median orifice. This structure is both simple and inexpensive to manufacture.

Although the invention has been described with dates that correspond to the days of the month, the invention also applies to any other type of date, for example the seven days of the week, the weeks of the year, or the twelve months of the year, with the control wheel having one portion provided with a number of teeth equal to (1+Q)/2, where Q is the number of dates to be displayed.

Although the invention has been described with two date rings, one could also envisage implementing a larger number of date rings and tiers for the control wheel within the scope of the invention.

What is claimed is:

1. A date mechanism for a timepiece, including:

at least first and second date rings, rotatably mounted relative to each other, said first and second date rings (2, 3) having one surface provided with successive date markings, the first date ring having a display window, arranged between two successive markings, the first date ring being superposed on the second date ring, each of said first and second date rings having teeth distributed on the periphery thereof, each tooth being associated with a respective marking or with the display window;

a control wheel for the first and second date rings;

wherein the control wheel is provided with first and second superposed tiers of toothings, each toothing tier including one portion provided with adjacent teeth and one tooth-free portion, the tooth-free portion of one tier being arranged vertical to the toothed portion of the other tier, one tooth of the first tier being superposed on one tooth of the second tier, the teeth of the first and second tiers of the control wheel respectively driving the first and second date rings via the teeth thereof.

2. The date mechanism according to claim 1, wherein the successive markings of said date rings are reference numerals from 1 to 31.

3. The date mechanism according to claim 2, wherein the first date ring has 15 markings and wherein the second date ring has 16 markings.

4. The date mechanism according to claim 2, wherein the control wheel is driven so as to complete one revolution in 31 days.

5. The date mechanism according to claim 3, wherein the control wheel is driven so as to complete one revolution in 31 days.

6. The date mechanism according to claim 1, wherein the date rings each have a bore in the central part thereof, and wherein their teeth project towards the inside of said bore.

7. The date mechanism according to claim 1, wherein the date rings are flat.

8. The date mechanism according to claim 6, wherein the date rings include a cut metal sheet with a bore, the sheet metal defining teeth regularly distributed over the periphery of the bore, said teeth being driven by the teeth of the control wheel.

9. The date mechanism according to claim 7, wherein the date rings include a cut metal sheet with a bore, the sheet metal defining teeth regularly distributed over the periphery of the bore, said teeth being driven by the teeth of the control wheel.

10. The date mechanism according to claim 1, wherein a single tooth corresponds to each marking or window carried by the date rings, said date rings being driven via said tooth by the control wheel.

11. The date mechanism according to claim 1, wherein the control wheel includes first and second metal sheets cut and secured to each other, the first and second metal sheets forming said first and second respective tiers of toothings.

12. The date mechanism according to claim 1, wherein the teeth of one toothing tier of the control wheel are regularly spaced.

13. The date mechanism according to claim 1, wherein it includes first, second, third and fourth gear reduction wheel sets, respectively coupled between the first and second tiers of toothings and the first and second date rings, each wheel set including one wheel and one pinion which are coaxial and secured to each other, the wheels and pinions being rotatably mounted about the same axis.

14. The watch including a date mechanism according to claim 1, the watch including:

a bottom plate guiding the date mechanism rings in rotation;

a plate covering the mechanism secured to the bottom plate, in which an aperture is arranged, so as to display the ring markings in the aperture.

* * * * *